US011844475B2

(12) United States Patent
Kim

(10) Patent No.: US 11,844,475 B2
(45) Date of Patent: Dec. 19, 2023

(54) AI ROBOT CLEANER AND ROBOT SYSTEM HAVING THE SAME

(71) Applicant: LG ELECTRONICS INC., Seoul (KR)

(72) Inventor: Gangeun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 588 days.

(21) Appl. No.: 16/943,691

(22) Filed: Jul. 30, 2020

(65) Prior Publication Data

US 2021/0030241 A1 Feb. 4, 2021

(30) Foreign Application Priority Data

Jul. 31, 2019 (KR) ..... 10-2019-0093473

(51) Int. Cl.
*A47L 11/40* (2006.01)
*A47L 11/282* (2006.01)

(52) U.S. Cl.
CPC ..... *A47L 11/4011* (2013.01); *A47L 11/282* (2013.01); *A47L 11/4008* (2013.01); *A47L 11/4038* (2013.01); *A47L 11/4066* (2013.01); *A47L 11/4069* (2013.01); *A47L 11/4088* (2013.01); *A47L 2201/04* (2013.01); *A47L 2201/06* (2013.01)

(58) Field of Classification Search
CPC ..... A47L 11/28; A47L 11/282; A47L 11/283; A47L 11/4008; A47L 11/4011; A47L 11/4036; A47L 11/4038; A47L 11/4041; A47L 11/4069; A47L 2201/00; A47L 2201/04; A47L 2201/06
See application file for complete search history.

(56) References Cited

U.S. PATENT DOCUMENTS

2006/0293788 A1* 12/2006 Pogodin ..... G05D 1/0011 701/23

FOREIGN PATENT DOCUMENTS

CN 106073630 A 11/2016
CN 207755209 U 8/2018
CN 109589050 A 4/2019
(Continued)

OTHER PUBLICATIONS

Machine Translation of KR20180008251A, Jang et al., Jan. 2018. (Year: 2018).*
(Continued)

*Primary Examiner* — David G Cormier
(74) *Attorney, Agent, or Firm* — Birch, Stewart, Kolasch & Birch, LLP

(57) ABSTRACT

A robot cleaner of the present disclosure includes: a main body forming an outer shape; a pair of rotary mops configured to rotate in contact with a floor to move the main body; a drive motor configured to rotate the pair of rotary mops; a mop sensing unit comprising at least one micro switch provided on a surface of the rotating plate configured to output a sensing signal when the mop cloth is attached; and a controller configured to determine attachment state of the mop cloth based on the sensing signal and control the driving of the rotary mop. Accordingly, the robot cleaner may detect whether the mop cloth is attached to the rotating mop, and alert the user, thereby protecting the floor by preventing wet cleaning without the mop.

15 Claims, 9 Drawing Sheets

(56) References Cited

FOREIGN PATENT DOCUMENTS

| | | | | |
|---|---|---|---|---|
| CN | 109688884 | A | | 4/2019 |
| KR | 10108004 | B1 | * | 11/2004 |
| KR | 20180008251 | A | * | 1/2018 |

OTHER PUBLICATIONS

Machine Translation of KR10108004B1, Lee et al., Nov. 2004. (Year: 2004).*

* cited by examiner

AI ROBOT CLEANER AND ROBOT SYSTEM HAVING THE SAME

CROSS-REFERENCE TO RELATED APPLICATION

This application claims priority under 35 USC § 119 to Korean Application No. 10-2019-0093473, filed on Jul. 31, 2019, whose entire disclosure is hereby incorporated by reference.

TECHNICAL FIELD

The present disclosure relates to a robot cleaner and a method for controlling the robot cleaner, and more particularly, to a control method of an artificial intelligence robot cleaner using a rotary mop.

BACKGROUND

Recently, the use of robots in the home is gradually increasing. A representative example of such a home robot is a cleaning robot. The cleaning robot is a moving robot that travels on a certain zone by itself, and sucks foreign matter such as dust accumulated on the floor to clean a cleaning space automatically, or can be moved by using a rotary mop and perform cleaning by using the rotary mop to wipe the floor. In addition, is also possible to mop the floor by supplying water to the rotary mop.

However, if the water supplied to the rotary mop is not properly adjusted, there is a problem in that the floor cannot be cleaned appropriately, as if excessive water is remained on the floor to be cleaned or the floor is wiped with a dry mop. In the case of Korean Publication Patent No. 1020040052094, a cleaning robot capable of performing water cleaning, while including a mop roller having a mop cloth on its outer circumferential surface to wipe off the steam sprayed on the floor with dust, is disclosed. Such a cleaning robot sprays steam on the surface of the cleaning floor for wet cleaning, and has a cloth for mop to wipe off the sprayed steam and dust. In addition, Korean Publication Patent No. 20140146702 discloses a robot cleaner for determining whether water can be accommodated inside a robot cleaner capable of performing wet cleaning, and a control method thereof.

Meanwhile, Korean Patent Publication No. KR20090019480A discloses a robot cleaner equipped with an infrared sensor for simultaneously detecting a step and a threshold as well as a floor and a cliff while traveling a cleaning zone.

However, at present, a mop cloth of a water mop cleaner must be attached and used, but a technique capable of checking whether or not such a mop cloth is attached has not been disclosed.

Patent Document

Korean Patent Publication No. 1020040052094 (published. Jun. 19, 2004)

Korean Patent Publication No. 20140146702 (published Dec. 29, 2014)

Korean Patent Publication No. KR20090019480 (published. Feb. 25, 2009)

SUMMARY

An object of the present disclosure is to provide a control method of a robot cleaner capable of detecting whether a mop cloth is attached to a rotating mop and alarming the user.

Another object of the present disclosure is to provide a control method of the robot cleaner capable of transmitting a control signal when the switch is turned on by attaching the mop cloth by placing a simple micro switch between the mop cloth and the rotating mop.

Another object of the present disclosure is to provide a control method of the robot cleaner capable of protecting the floor by preventing the mop cleaning without the mop by a simple structure change or simple element attachment.

The present disclosure is not limited to the problems mentioned above, and other problems not mentioned will be clearly understood by those skilled in the art from the following description.

In an aspect, there is provided a robot cleaner including: a main body configured to form an outer shape; a pair of rotary mop configured to move the main body while rotating in contact with a floor, and perform cleaning by a mop cloth attached to a lower rotating plate; a drive motor configured to rotate the pair of rotary mop; a mop sensing unit configured to include at least one micro switch provided on a surface of the rotating plate, detect a presence of a mop cloth and output a sensing signal when the mop cloth is attached; and a controller configured to determine attachment state of the mop cloth according to the sensing signal from the mop detection unit, and control the driving of the rotary mop.

The mop detection unit is disposed toward the mop cloth on the rotating plate.

The micro switch is applied with a reference voltage, and outputs the reference voltage as the sensing signal to the controller when the mop cloth is attached.

A plurality of micro-switches is arranged on each rotary mop, and the controller determines the attachment state of the mop cloth by obtaining the sensing signals from the plurality of micro-switches.

The controller determines that the mop cloth is normally attached when the reference voltages are all transmitted as the sensing signals from a plurality of micro-switches.

The controller determines that the mop cloth is normally attached when the reference voltage is transmitted for a predetermined time or more.

The controller determines that the mop cloth is abnormally attached when the sensing signal of at least one of the plurality of micro-switches is not the reference voltage.

The controller determines that the mop cloth is not attached when the sensing signals of the plurality of micro-switches are not all of the reference voltages.

The micro-switch includes: a spring to which a reference voltage is applied, an output terminal spaced apart from the spring and outputting the sensing signal, an actuator energizing the spring and the output terminal by external pressure, and a molding case molding the spring and output terminal.

The micro-switch transmits the reference voltage to the output terminal while the spring and the output terminal are in contact when the mop cloth is attached.

The controller transmits information to an alarm to a user terminal when the mop cloth is abnormally attached.

In another aspect, there is provided a robot system including a robot cleaner is configured to perform wet cleaning in cleaning area; a server is configured to transmit and receive the robot cleaner and perform control of the robot cleaner; and a user terminal is configured to interwork with the robot cleaner and the server, and control the robot cleaner to activate an application for control of the robot cleaner, wherein the robot cleaner includes a main body configured to form an outer shape; a pair of rotary mop configured to move the main body while rotating in contact with a floor, and perform cleaning by a mop cloth attached to a lower rotating plate; a drive motor configured to rotate the pair of rotary mop; a mop sensing unit configured to include at least one micro switch provided on a surface of the rotating plate, detect a presence of a mop cloth and output a sensing signal when the mop cloth is attached; and a controller configured to determine attachment state of the mop cloth according to the sensing signal from the mop detection unit, and control the driving of the rotary mop.

The mop detection unit is disposed toward the mop cloth on the rotating plate.

The micro-switch is applied with a reference voltage, and outputs the reference voltage as the sensing signal to the controller when the mop cloth is attached.

A plurality of micro-switches is arranged on each rotary mop, and the controller determines the attachment state of the mop cloth by obtaining the sensing signals from the plurality of micro-switches.

The controller determines that the mop cloth is normally attached when the reference voltages are all transmitted as the sensing signals from a plurality of micro-switches, the controller determines that the mop cloth is abnormally attached when the sensing signal of at least one of the plurality of micro-switches is not the reference voltage, and the controller determines that the mop cloth is not attached when the sensing signals of the plurality of micro-switches are not all of the reference voltages.

The controller periodically receives the sensing signal from the mop detection unit, analyzes, determines an attachment state of the mop cloth, and transmits information of the attachment state to the application of the user terminal.

According to the robot cleaner of the present disclosure, there are one or more of the following effects.

The present disclosure can provide the control method of a robot cleaner capable of detecting whether a mop cloth is attached to a rotating mop and alarming the user.

In addition, the control signal can be transmitted when the switch is turned on by attaching the mop cloth by placing a simple micro switch between the mop cloth and the rotating mop.

And, when using the mop robot cleaner, it is possible to protect the floor by preventing the mop cleaning without a mop by simple structure change or simple element attachment.

The effects of the present disclosure are not limited to the effects mentioned above, and other effects not mentioned will be clearly understood by those skilled in the art from the description of the claims.

DETAILED DESCRIPTION

Figure 1:
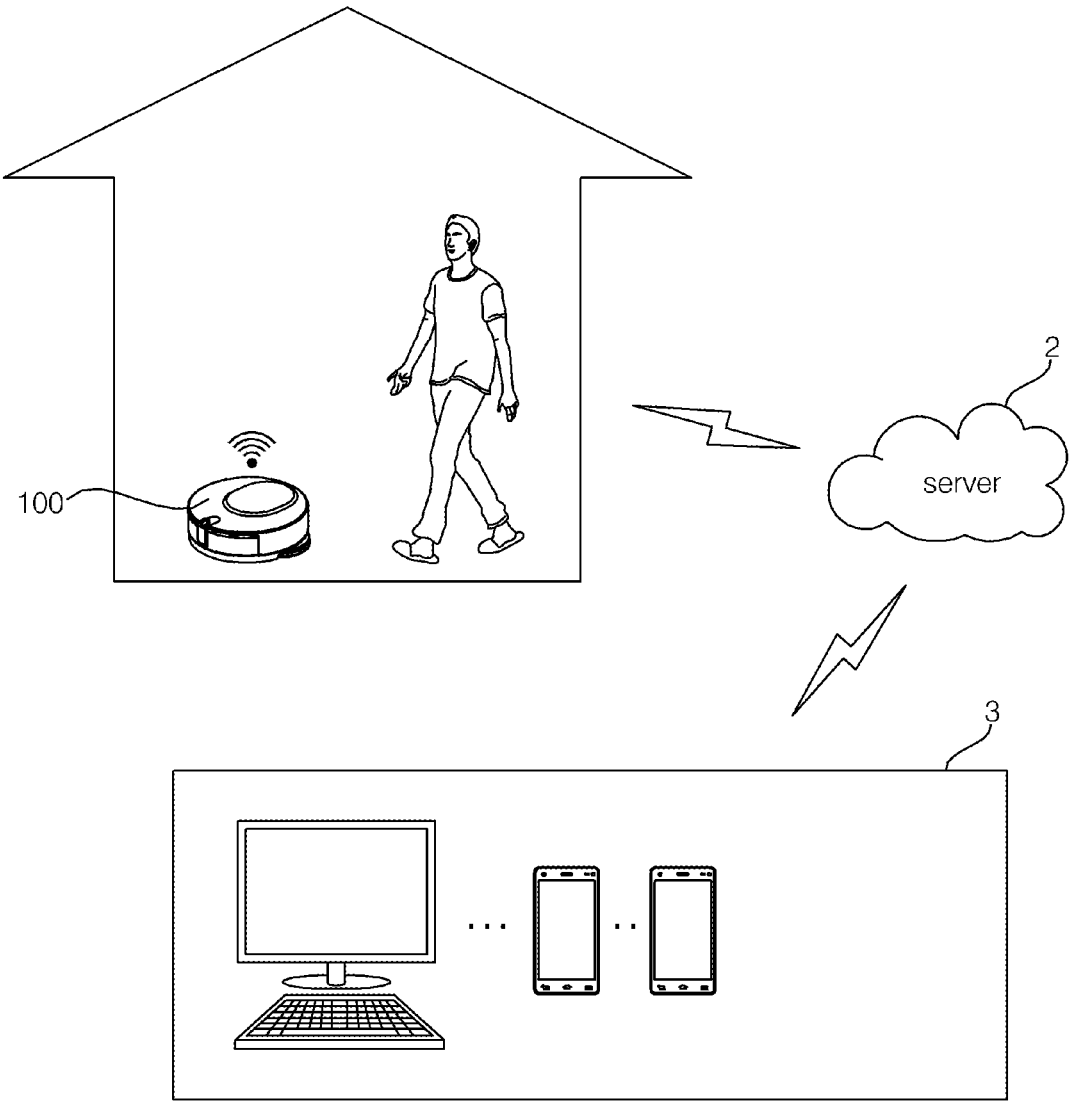
FIG. 1 is a constitutional view of a robot system including a robot cleaner according to an embodiment of the present disclosure.

Expressions referring to directions such as "front (F)/rear (R)/left (Le)/right (Ri)/upper (U)/lower (D)" mentioned below are defined based on the illustrations in the drawings, but this is merely given to describe the present disclosure for clear understanding thereof, and it goes without saying that the respective directions may be defined differently depending on where the reference is placed.

The use of terms in front of which adjectives such as "first" and "second" are used in the description of constituent elements mentioned below is intended only to avoid confusion of the constituent elements, and is unrelated to the order, importance, or relationship between the constituent elements. For example, an embodiment including only a second component but lacking a first component is also feasible.

The thickness or size of each constituent element shown in the drawings may be exaggerated, omitted or schematically drawn for the convenience and clarity of explanation. The size or area of each constituent element may not utterly reflect the actual size or area thereof.

Angles or directions used to describe the structure of the present disclosure are based on those shown in the drawings. Unless a reference point with respect to an angle or positional relationship in the structure of the present disclosure is clearly described in the specification, the related drawings may be referred to.

FIG. 1 is a constitutional view of an artificial-intelligence robot system according to an embodiment of the present disclosure.

Referring to FIG. 1, the robot system according to the embodiment of the present disclosure may include at least one robot cleaner 100 for providing a service in a prescribed place such as a house. For example, the robot system may include a home robot cleaner 100, which interacts with a user at home and provides various forms of entertainment to the user. In addition, the home robot cleaner 100 may perform online shopping or online ordering and may provide a payment service in accordance with the user request.

Preferably, the robot system according to the embodiment of the present disclosure may include a plurality of artificial-intelligence robot cleaners 100 and a server 2 capable of managing and controlling the plurality of artificial-intelligence robot cleaners 100. The server 2 may monitor and control the status of the plurality of robots 1 from a remote place, and the robot system may provide a service more effectively using the plurality of robots 1.

The plurality of robot cleaners 100 and the server 2 may include a communication module (not shown), which supports one or more communication standards, so as to communicate with each other. In addition, the plurality of robot cleaners 100 and the server 2 may communicate with a PC, a mobile terminal, and another external server 2.

For example, the plurality of robot cleaners 100 and the server 2 may implement wireless communication using a wireless communication technology such as IEEE 802.11 WLAN, IEEE 802.15 WPAN, UWB, Wi-Fi, ZigBee, Z-wave, Bluetooth, or the like. The robot cleaners 100 may be configured differently depending on the type of communication of other devices, with which the robot cleaners 100 intend to communicate, or the server 2.

In particular, the plurality of robot cleaners 100 may communicate with another robot cleaner 100 and/or the server 2 in a wireless manner over a 5G network. When the robot cleaners 100 implement wireless communication over a 5G network, real-time response and real-time control are possible.

The user may confirm information on the robot cleaners 100 in the robot system through a user terminal 3 such as a PC or a mobile terminal.

The server 2 may be implemented as a cloud server 2, and the cloud server 2 may be interlocked with the robot cleaners 100 so as to monitor and control the robot cleaners 100 and remotely provide various solutions and contents.

The server 2 may store and manage information received from the robot cleaners 100 and other devices. The server 2 may be a server 2 that is provided by a manufacturer of the robot cleaners 100 or a company entrusted with the service by the manufacturer. The server 2 may be a control server 2 that manages and controls the robot cleaners 100.

The server 2 may control the robot cleaners 100 collectively and uniformly, or may control the robot cleaners 100 individually. Meanwhile, the server 2 may be implemented as multiple servers to which pieces of information and functions are dispersed, or may be implemented as a single integrated server.

The robot cleaners 100 and the server 2 may include a communication module (not shown), which supports one or more communication standards, for communication therebetween.

The robot cleaners 100 may transmit data related to space, objects, and usage to the server 2.

Here, the data related to space and objects may be data related to recognition of space and objects that is recognized by the robot cleaners 100, or may be image data on space and objects that is acquired by an image acquisition unit.

Depending on the embodiment, the robot cleaners 100 and the server 2 may include artificial neural networks (ANN) in the form of software or hardware that has learned to recognize at least one of a user, a voice, properties of space, or properties of an object such as an obstacle.

According to the embodiment of the present disclosure, the robot cleaners 100 and the server 2 may include a deep neural network (DNN), such as a convolutional neural network (CNN), a recurrent neural network (RNN), or a deep belief network (DBN), which has been trained through deep learning. For example, the controller 140 of each robot cleaner 100 may be equipped with a deep neural network (DNN) structure such as a convolutional neural network (CNN).

The server 2 may train the deep neural network (DNN) based on data received from the robot cleaners 100 or data input by the user, and thereafter may transmit the updated data on the deep neural network (DNN) structure to the robots 1. Accordingly, the artificial-intelligence deep neural network (DNN) structure provided in the robot cleaners 100 may be updated.

Data related to usage may be data acquired in accordance with use of the robot cleaners 100. Data on use history or a sensing signal acquired through a sensor unit 110 may correspond to the data related to usage.

The trained deep neural network (DNN) structure may receive input data for recognition, may recognize properties of people, objects, and space included in the input data, and may output the result of recognition.

In addition, the trained deep neural network (DNN) structure may receive input data for recognition, may analyze and learn data related to usage of the robot cleaners 100, and may recognize a usage pattern and a usage environment.

Meanwhile, the data related to space, objects, and usage may be transmitted to the server 2 via a communication unit.

The server 2 may train the deep neural network (DNN) based on the received data, and thereafter may transmit the updated data on the deep neural network (DNN) structure to the artificial-intelligence robot cleaners 100 so that the robots update the deep neural network (DNN) structure.

Accordingly, the robot cleaners 100 may continually become smarter, and may provide a user experience (UX) that evolves as the robot cleaners 100 are used.

Meanwhile, the server 2 can provide information about the control and the current state of the robot cleaner 100 to the user terminal, and can generate and distribute an application for controlling the robot cleaner 100.

Such an application may be an application for a PC applied as the user terminal 3 or an application for a smartphone.

For example, it may be an application for controlling a smart home appliance, such as a SmartThinQ application, which is an application that can simultaneously control and manage various electronic products of the present applicant.

Figure 2:
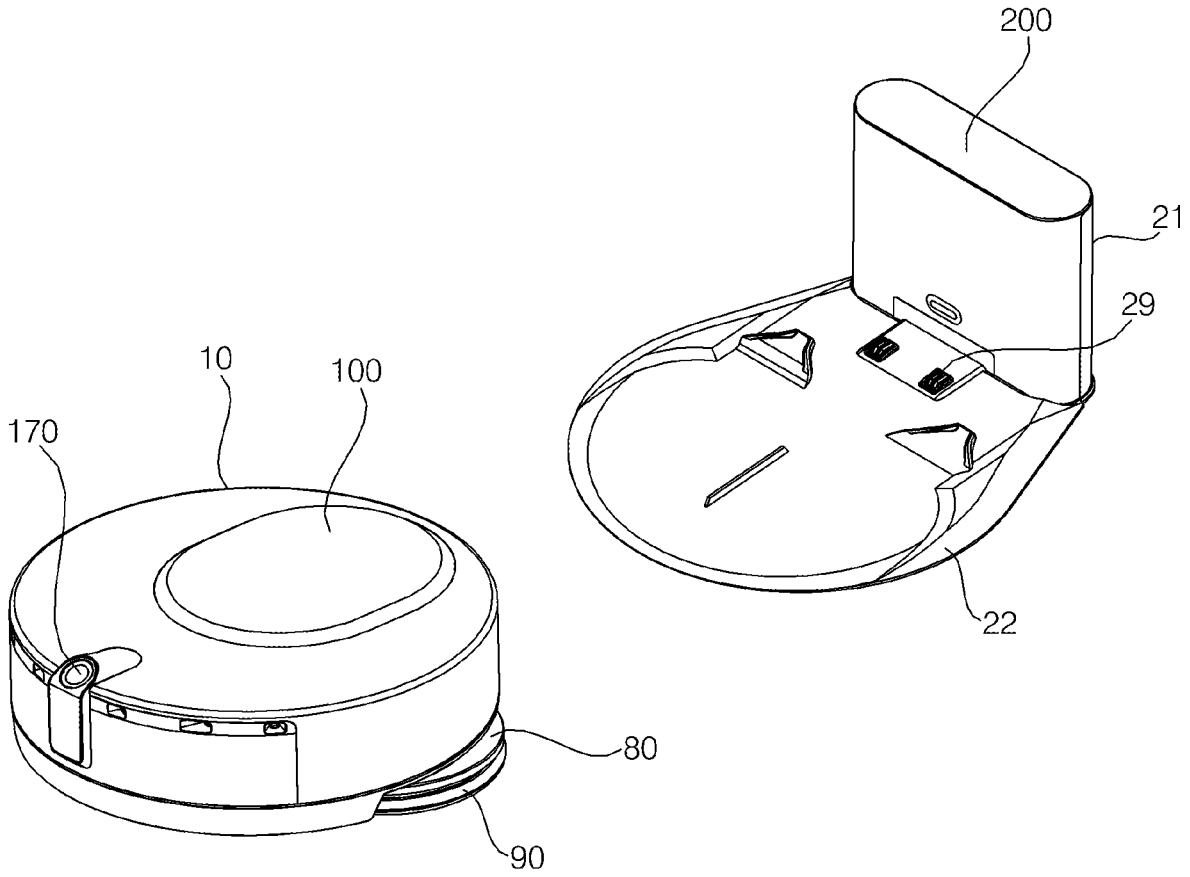
FIG. 2 is a perspective view of a robot cleaner according to an embodiment of the present disclosure.
Figure 3:
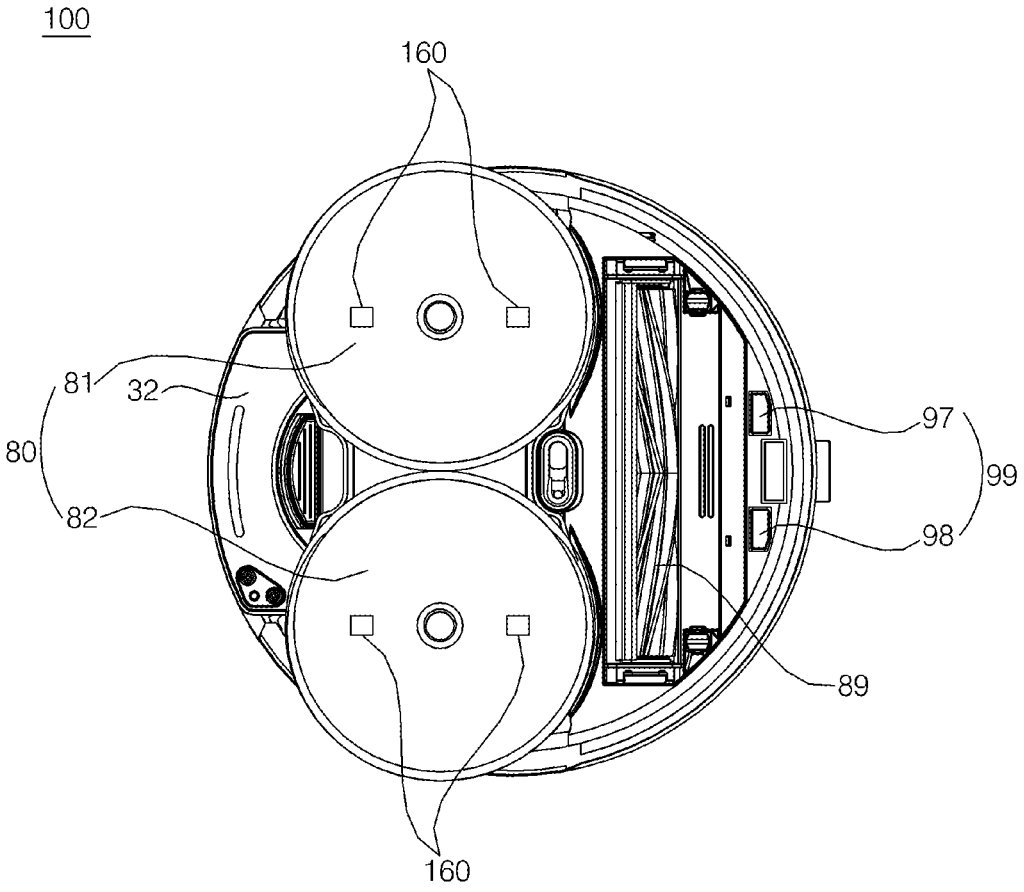
FIG. 3 is a bottom view of the robot cleaner of FIG. 2.
Figure 4:
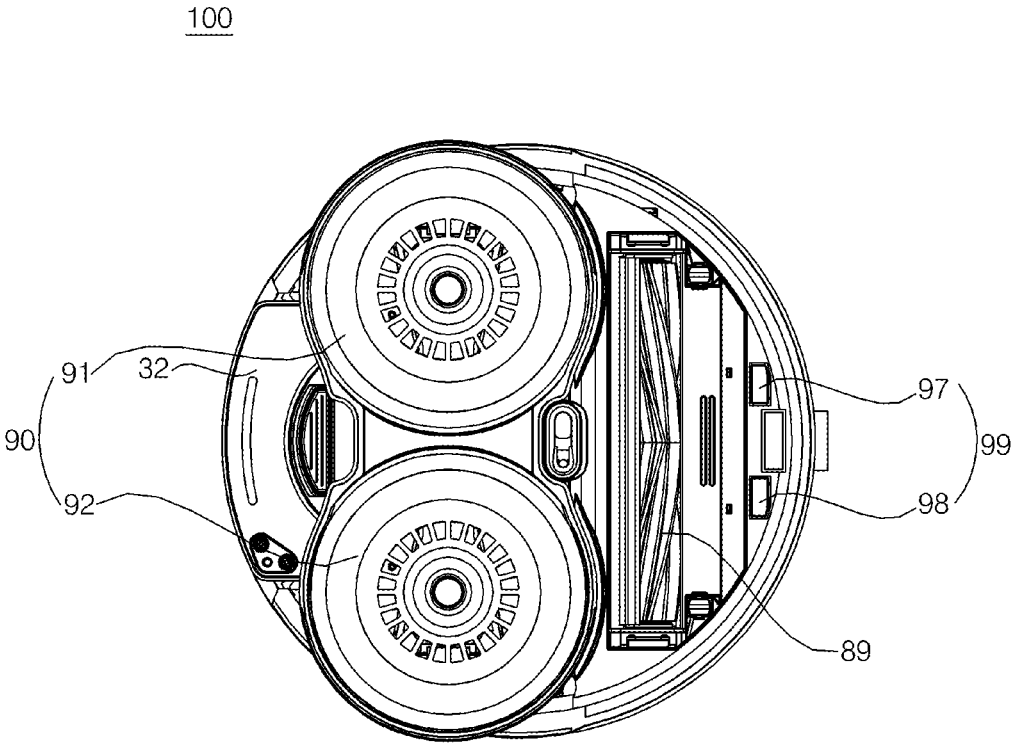
FIG. 4 is another state diagram of the bottom view of the robot cleaner of FIG. 3.

FIG. 2 is a perspective view of a robot cleaner according to an embodiment of the present disclosure, FIG. 3 is a bottom view of the robot cleaner of FIG. 2, and FIG. 4 is another state diagram of the bottom view of the robot cleaner of FIG. 3.

Referring to FIGS. 2 to 4, the configuration of the robot cleaner 100 in motion by the rotation of the rotary mop according to the present embodiment will be described briefly.

The robot cleaner 100 according to an embodiment of the present disclosure moves in a zone, and removes foreign matter on the floor during traveling.

In addition, the robot cleaner 100 stores the charging power supplied from a charging stand 200 in a battery (not shown) and travels the zone.

The robot cleaner 100 includes a main body 10 performing a designated operation, an obstacle detecting unit (not shown) which is disposed in the front surface of the main body 10 and detects an obstacle, and an image acquisition unit 170 photographing a 360 degree image. The main body 10 includes a casing (not shown) which forms an outer shape and forms a space in which components constituting the main body 10 are accommodated, a rotary mop 80 which is rotatably provided, a roller 89 which assists movement of the main body 10 and the cleaning, and a charging terminal 99 to which charging power is supplied from the charging stand 2.

The rotary mop 80 is disposed in the casing and formed toward the floor surface and the mop cloth is configured to be detachable.

The rotary mop 80 includes a first rotating plate 81 and a second rotating plate 82 to allow the body 10 to move along the floor of the zone through rotation.

When the rotary mop 80 used in the robot cleaner 100 of the present embodiment rotates, a slip may occur so that the robot cleaner 100 does not move in comparison with the actual rotation of the rotary mop. The rotary mop may include a rolling mop driven by a rotation axis parallel to the floor, or a spin mop driven by a rotation axis almost perpendicular to the floor.

When the rotary mop 80 includes the spin mop, the output current value of a drive motor for rotating the spin mop may vary according to a percentage of water content which is a ratio of contained water. The percentage of water content means the degree to which the spin mop contains water, and the state with a percentage of water content "0" means a state in which no water is contained in the spin mop. The percentage of water content according to the present embodiment may be set to a ratio containing water according to the weight of the mop cloth. The spin mop may contain water having the same weight as that of the mop, or may contain water in excess of the weight of the mop.

As the rotary mop 80 contains more water, the percentage of water content becomes higher, and the frictional force with the floor surface becomes greater due to the influence of water, thereby reducing the rotation speed.

The decrease in the rotation speed of the drive motor 38 means that the torque of the drive motor 38 is increased, thereby increasing the output current of the drive motor 38 for rotating the spin mop.

That is, a relationship that the output current of the drive motor 38 for rotating the spin mop is increased by the frictional force that is increased as the percentage of water content is increased is established.

In addition, the controller 150 may vary the output current of the drive motor 38 for a certain time to transmit various information. This will be described later.

The robot cleaner 100 according to the present embodiment may further include a water tank 32 which is disposed inside the main body 10 and stores water, a pump 34 for supplying water stored in the water tank 32 to the rotary mop 80, and a connection hose for forming a connection flow path connecting the pump 34 and the water tank 32 or connecting the pump 34 and the rotary mop 80.

The robot vacuum cleaner 100 according to the present embodiment includes a pair of rotary mops 80 and moves by rotating the pair of rotary mops 80.

The main body 10 travels forward, backward, left, and right as the first rotating plate 81 and the second rotating plate 82 of the rotary mop 80 rotate about a rotating shaft. In addition, as the first and second rotating plates 81 and 82 rotate, the main body 10 performs wet cleaning as foreign matter on the floor surface is removed by the attached mop cloth.

The main body 10 may include a driving unit (not shown) for driving the first rotating plate 81 and the second rotating plate 82. The driving unit may include at least one drive motor 38.

The upper surface of the main body 10 may be provided with a control panel including an operation unit (not shown) that receives various commands for controlling the robot cleaner 100 from a user.

In addition, the image acquisition unit 170 is disposed in the front or upper surface of the main body 10.

The image acquisition unit 170 captures an image of an indoor area.

On the basis of the image captured by the image acquisition unit 170, it is possible to detect obstacles around the main body as well as to monitor the indoor area.

The image acquisition unit 170 may be disposed toward the front and upper direction at a certain angle to photograph the front and the upper side of the moving robot. The image acquisition unit 170 may further include a separate camera for photographing the front. The image acquisition unit 170 may be disposed above the main body 10 to face a ceiling, and in some cases, a plurality of cameras may be provided. In addition, the image acquisition unit 170 may be separately provided with a camera for photographing the floor surface.

The robot cleaner 100 may further include position obtaining means (not shown) for obtaining current position information. The robot cleaner 100 may include GPS and UWB to determine the current position. In addition, the robot cleaner 100 may determine the current position by using the image.

The main body 10 includes a rechargeable battery (not shown), and a charging terminal 99 of the battery may be connected to a commercial power source (e.g., a power outlet in a home) or the main body 10 may be docked to the charging stand 200 connected to the commercial power source, so that the charging terminal may be electrically connected to the commercial power source through contact with a terminal 29 of the charging stand and the battery may be charged by the charging power supplied to the main body 10.

The electric components constituting the robot cleaner 100 may be supplied with power from a battery, and thus, the robot cleaner 100 may automatically move in a state in which the robot cleaner 100 is electrically separated from commercial power.

Hereinafter, it will be described on the assumption that the robot cleaner 100 is a wet cleaning moving robot. However, the robot cleaner 100 is not limited thereto and it should be noted that any robot that detects sound while autonomously traveling a zone can be applicable.

FIG. 4 is a diagram illustrating an embodiment in which a mop cloth is attached to the moving robot of FIG. 2.

As shown in FIG. 4, the rotary mop 80 includes a first rotating plate 81 and a second rotating plate 82.

The first rotating plate 81 and the second rotating plate 82 may be provided with attached mop cloth 90(91, 92), respectively.

The rotary mop 80 is configured such that mop cloth 90(91, 92) can be detachable. The rotary mop 80 may have a mounting member for attachment of the mop cloth 90(91, 92) provided in the first rotating plate 81 and the second rotating plate 82, respectively. For example, the rotary mop 80 may be provided with a velcro, a fitting member, or the like so that the mop cloth 90(91, 92) can be attached and fixed. In addition, the rotary mop 80 may further include a mop cloth frame (not shown) as a separate auxiliary means for fixing the mop cloth 90(91, 92) to the first rotating plate 81 and the second rotating plate 82.

The mop cloth 90 absorbs water to remove foreign matter through friction with the floor surface. The mop cloth 90 is preferably a material such as cotton fabric or cotton blend, but any material containing moisture in a certain ratio or higher and having a certain density can be used, and the material is not limited.

The mop cloth 90 is formed in a circular shape.

The shape of the mop cloth 90 is not limited to the drawing and may be formed in a quadrangle, polygon, or the like. However, considering the rotational motion of the first and second rotating plates 81 and 82, it is preferable that the first and second rotating plates 81 are configured in a shape that does not interfere with the rotation operation of the first and second rotating plates 81 and 82. In addition, the shape of the mop cloth 90 can be changed into a circular shape by the mop cloth frame provided separately.

The rotary mop 80 is configured such that when the mop cloth 90 is mounted, the mop cloth 90 comes into contact with the floor surface. Considering the thickness of the mop cloth 90, the rotary mop 80 is configured to change a separation distance between a casing and the first and second rotating plates 81 and 82 according to the thickness of the mop cloth 90.

The rotary mop 80 adjusts the separation distance between the casing and the rotating plate 81, 82 so that the mop cloth 90 comes in contact with the floor surface, and the rotating plates 81, 82 includes a mop fixing part (not shown) for fixing the mop cloth 90. The mop fixing part may fix the mop cloth 90 in a detachable manner. The mop fixing part may be a velcro or the like disposed below the rotating plate 81, 82. The mop fixing part may be a book or the like disposed in the edge of the rotating plate 81, 82.

At least one mop detection unit 160 is formed between the mop cloth 90 and the rotating plates 81 and 82.

The mop detection unit 160 may be provided on the rotating plates 81 and 82 of the area where the rotating plates 81 and 82 and the mop cloth 90 are attached flat.

A fixed portion such as a Velcro may not be formed in the area where the mop detection unit 160 is formed, and at least one mop detection unit 160 may be disposed on one side of the rotating plates 81 and 82.

At this time, the mop detection unit 160 may be implemented as a pressure sensor that detects that the mop cloth 90 is attached to the rotating plates 81 and 82 and transmits a sensing signal to the controller 150.

That is, the mop detection unit 160 may be implemented as a micro switch.

Hereinafter, a micro switch will be described with reference to FIG. 5.

Figure 5:
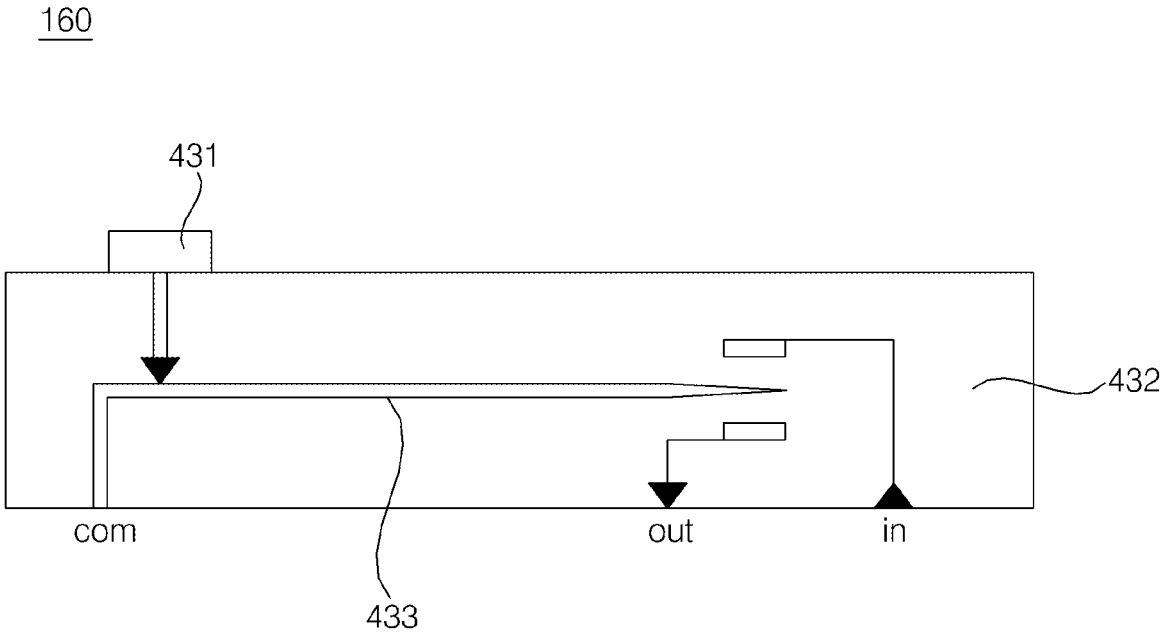
FIG. 5 shows an example of the mop detection unit of the present disclosure.

Referring to FIG. 5, the micro switch applicable to the mop sensing unit 160 is formed with a leaf spring 433 so that one end can be selectively contacted between two terminals (in, out) spaced apart from each other.

The leaf spring 433 functions as a kind of terminal, and the other end receives a reference voltage(com).

The leaf spring 433 selectively contacts the in terminal and the out terminal by the pressure of the actuator 431 partially exposed outside the case 432.

The case 432 is molded with an elastic material, for example, epoxy resin, etc., and when the out terminal of these two terminals comes into contact with the leaf spring 433 by pressing of the actuator 431, it is energized. The reference voltage com is transmitted to the out terminal.

Accordingly, the micro switch may transmit the corresponding reference voltage com to the controller 150 as a sensing signal by the external pressure, that is, pressing the actuator 431.

Such a micro switch can be designed in various ways, and it is possible to determine whether or not the mop cloth 90 is accurately fixed to the rotating plates 81 and 82 by obtaining the sensing signal for a plurality of micro switches and fusing them.

For example, two micro-switches may be provided on one side of the rotating plate 81 to be spaced apart from each other, and it is possible to distinguish the state in which the mop cloth 90 is not attached to the rotating plates 81 and 82 or the state in which the mop cloth 90 is not accurately fixed to the rotating plates 81 and 82 according to the sensing signals of the two micro-switches.

In the above, although the mop detection unit 160 is formed of the micro switch, unlike this, it is possible to determine whether the mop cloth 90 is attached using a photo sensor having a light source unit and a light receiving unit. That is, the light emitted from the light source unit is reflected by the mop cloth 90 when the mop cloth 90 is attached, and the wavelength of the light and the amount of light detected by the light receiving unit are variable.

The photo sensor may function as the mop detection unit 160 by sensing a change in the light received by the light receiving unit and transmitting it to the controller 150.

Hereinafter, with reference to FIGS. 6 to 8, the operation of detecting whether the robot cleaner is attached to the mop cloth 90 according to an embodiment of the present disclosure will be described.

Figure 6:
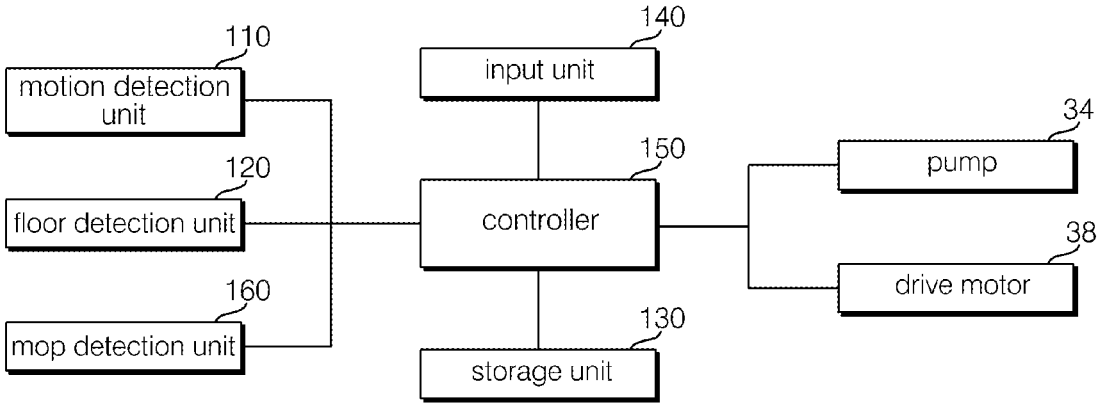
FIG. 6 is a block diagram showing a configuration related to the controller and the controller of the robot cleaner according to an embodiment of the present disclosure.
Figure 7:
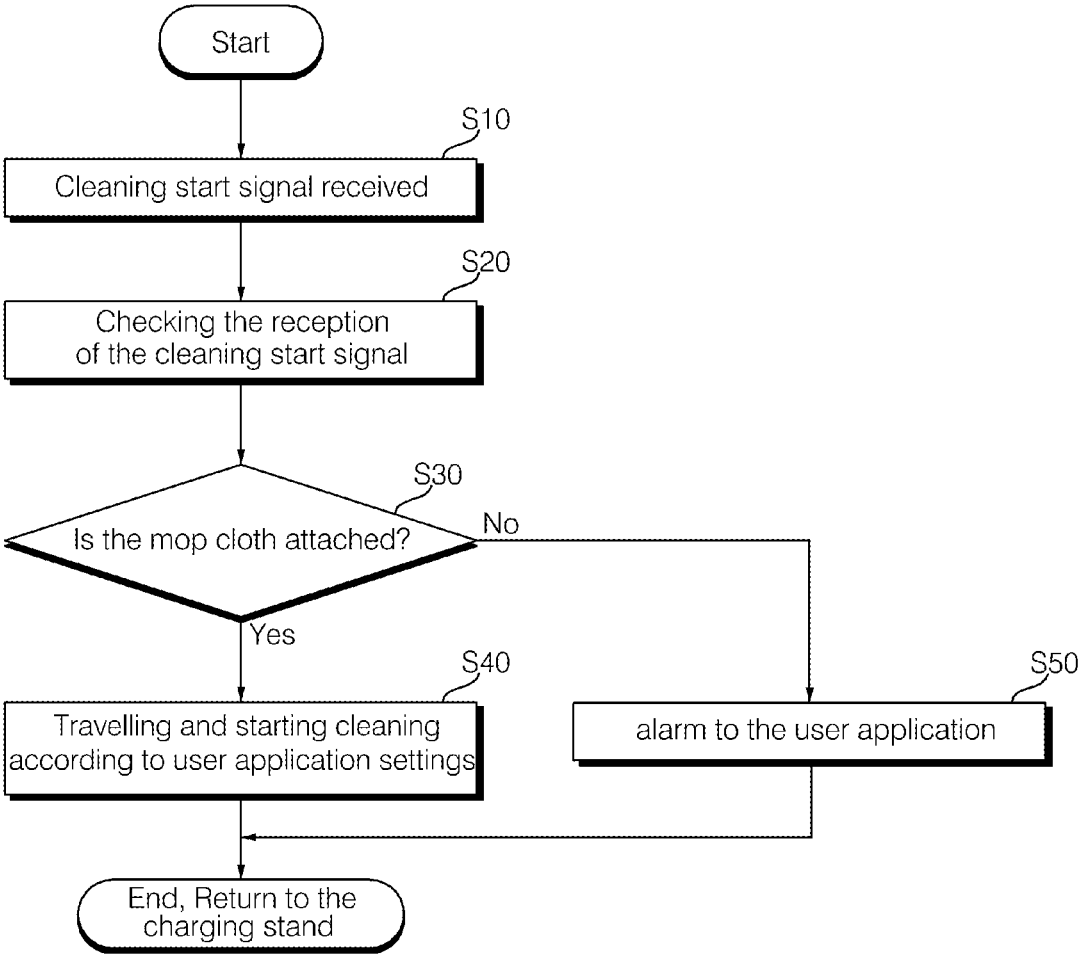
FIG. 7 is a flowchart illustrating a control method of the robot cleaner according to an embodiment of the present disclosure.
Figure 8:
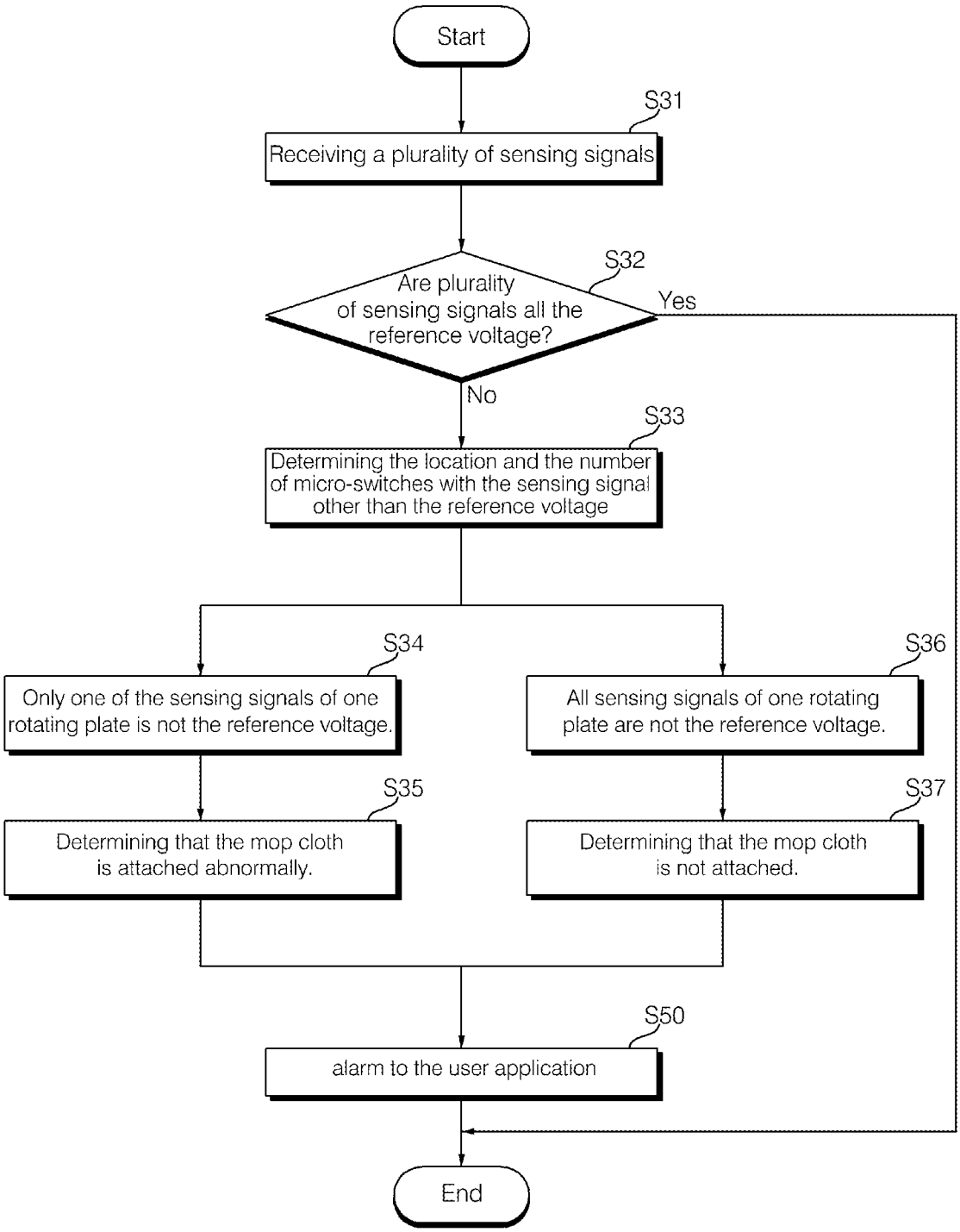
FIG. 8 is a detailed flowchart of a method for determining attachment of the mop cloth among the control methods of FIG. 7.
Figure 9A:
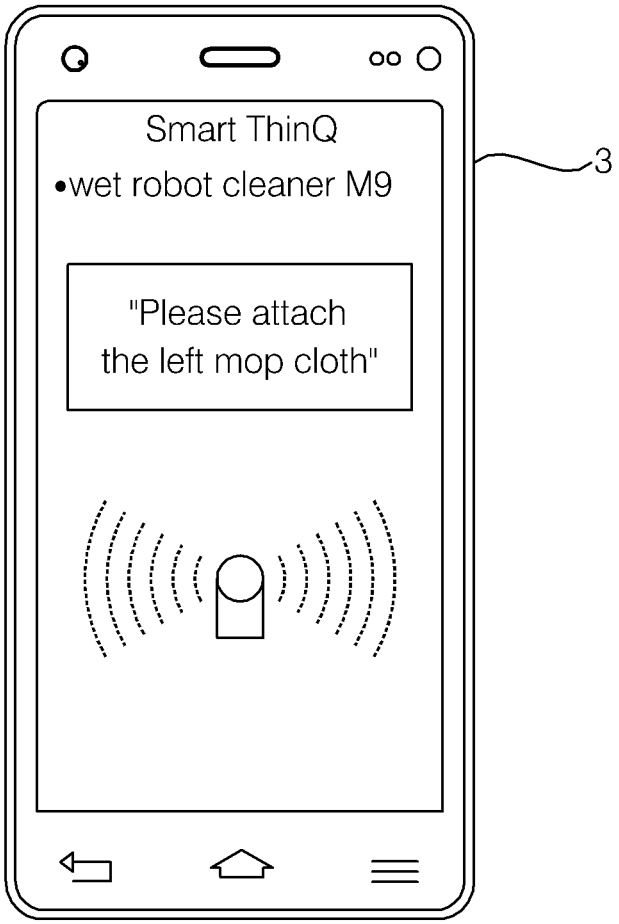
FIGS. 9A and 9B are diagrams showing a state of a user terminal according to FIG. 8.
Figure 9B:
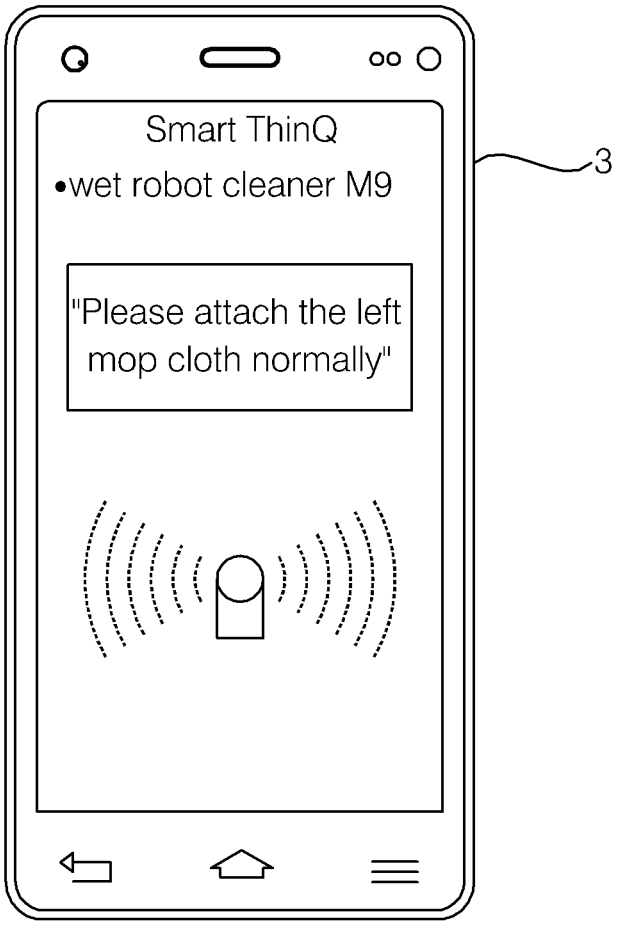

FIG. 6 is a block diagram showing a configuration related to the controller and the controller of the robot cleaner according to an embodiment of the present disclosure, FIG. 7 is a flowchart illustrating a control method of the robot cleaner according to an embodiment of the present disclosure, FIG. 8 is a detailed flowchart of a method for determining attachment of the mop cloth among the control methods of FIG. 7, and FIGS. 9A and 9B are diagrams showing a state of a user terminal according to FIG. 8.

The robot cleaner 100 according to the present embodiment further includes a motion detection unit 110 that detects the motion of the robot cleaner 100 according to a reference motion of the main body 10 when the rotary mop 80 rotates. The motion detection unit 110 may further include a gyro sensor that detects the rotational speed of the main body 10 or an acceleration sensor that senses an acceleration value of the robot cleaner 100. In addition, the motion detection unit 110 may use an encoder (not shown) that detects the moving distance of the robot cleaner 100.

The controller 150 of the robot cleaner 100 according to the present embodiment provides power to the drive motor 38 that rotates and controls the rotary mop 80 and controls the output current of the drive motor 38.

In addition, the controller 150 may control the pump 34, as described above, to control the water injection of the nozzle, and receive the sensing signal from each detection unit to control the operation of the robot cleaner 100.

At this time, the robot cleaner 100 may further include the mop detection unit 160.

The mop detecting unit 160 may be formed between the mop cloth 90 and the rotating plates 81 and 82 of the rotary mop 80 as described above, and the mop cloth 90 is provided on the rotating plates 81 and 82. It detects whether the mop cloth 90 is attached and outputs the sensing signal corresponding to this to the controller 150.

The controller 150 may be determined whether the rotating mop 80 includes a mop cloth 90, whether the mop cloth 90 is not attached to either of the rotating plates 81 and 82, or whether the mop cloth 90 of the rotating plates 81, 82 is attached out of the correct position according to the sensing signal from the mop detection unit 160. The controller 150 may read the sensing signal from the mop detection unit 160 to determine the state of the mop cloth 90 of the robot cleaner 100 and alarm the user.

Specifically, the controller 150 determines the attachment state of the rotating plates 81 and 82 of the mop cloth 90 based on whether there is the sensing signal having a voltage less than or equal to a predetermined size, whether or not it has the sensing signal having a predetermined pulse width or less, and whether the sensing signal from the specific mop detection unit 160 is not received among the received sensing signals.

The controller 150 may alert the user's attention by alarming the user terminal 3 or the like about this state.

The robot cleaner 100 may further include a floor detection unit including a cliff sensor that detects the presence of a cliff on the floor in the cleaning area. The cliff sensor according to the present embodiment may be disposed in the front portion of the robot cleaner 100. In addition, the cliff sensor according to the present embodiment may be disposed on one side of the bumper.

The controller 150 may determine the material of the floor based on the amount of reflected light received from the light-receiving element as the light output from the light-emitting element is reflected from the floor when a cliff sensor is included, but is not limited thereto.

The robot cleaner 100 according to the present embodiment may further include an input unit 140 for inputting a user's command. The user may set a driving method of the robot cleaner 100 or an operation of the rotary mop 80 through the input unit 140.

In addition, the robot cleaner 100 may further include a communication unit, and may provide an alarm or information according to the determination result of the controller 150 to the server 2 or the user terminal 3 through the communication unit.

Specifically, in the robot system including the robot cleaner 100 according to an embodiment of the present disclosure, the robot cleaner 100, the server 2, and the user terminal 3 perform wireless communication with each other to perform a robot cleaner 100 can be controlled.

First, the server 2 of the robot system produces a user application that can control the robot cleaner 100, and holds it in a state that can be distributed online.

The user terminal 3 downloads the user application online and installs it.

By executing the user application, membership and the robot cleaner 100 owned by the user are registered in the application, and the robot cleaner 100 is interlocked with the application.

The user terminal 3 can set various functions for the corresponding robot cleaner 100, and specifically, it can set a cleaning cycle, a setting of a detection cycle for a mop cloth attachment state, and a method of alarming the confirmed result according to such a cycle.

The cycle may be preferably 1 to 10 minutes, and more preferably 1 to 5 minutes.

As the alarm method, a sound alarm and a display alarm can be selected, and the alarm period can also be set.

In addition, the robot cleaner 100 itself may also provide an alarm to select a method for arousing the user's attention in addition to the display the alarm on the application of the user terminal 3 as the alarm method.

The user terminal 3 transmits data to the server 2 through the application for such setting information, and also transmits data for the detection cycle for the attachment state of the mop cloth 90 and alarm setting information through wireless communication to the robot cleaner 100.

Next, the robot cleaner 100 may receive a cleaning start command from the application of the user terminal 3 (S10). At this time, the start information from the application of the user terminal 3 can be transmitted to the server 2 and stored in the server 2.

The robot cleaner 100 controls the drive motor and the pump to start cleaning according to the received cleaning start command.

At this time, when the cleaning start command is received, the controller 150 of the robot cleaner 100 receives a plurality of sensing signals from the mop detection unit 160 (S20).

The controller 150 receives a plurality of sensing signals and determines whether the corresponding mop cloth 90 is properly attached to the rotating plates 81 and 82 (S30).

Specifically, as shown in FIG. 8, when two micro switches are spaced apart on one of the rotating plates 81 and 82, both sensing signals from the two spaced micro switches are received (S31).

At this time, it is determined whether all four received sensing signals indicate the reference voltage (S32).

At this time, when all four received sensing signals indicate the reference voltage and maintain and indicate the reference voltage for a predetermined time or more, it is determined that all the mop cloths 90 are accurately attached to the rotating plates 81 and 82.

Accordingly, the initial current value of the drive motor for starting the travelling is read according to the setting of the application of the user terminal 3, and the travelling and cleaning are performed while rotating the rotary mop 80 (S40). The rotary mop 80 also performs wet cleaning in a state including a predetermined moisture content according to water injection from the nozzle according to the pump driving.

At this time, the controller 150 may proceed with cleaning intensity and travelling by controlling the rotational direction and rotational speed of the rotary mop 80, and perform cleaning while traveling in a predetermined mode according to the cleaning area.

The controller 150 periodically receives the sensing signals from the mop detection units 160 of the rotating plates 81 and 82 at predetermined intervals, and periodically determines whether all of the sensing signals from the four micro switches indicate the reference voltage.

At this time, if some of the sensing signals from the plurality of micro switches do not indicate the reference voltage, the position and the number of the micro switches having the sensing signal other than the reference voltage are determined (S33).

At this time, if only one sensing signal among the two micro switches for one of the rotating plates 81 and 82 represents the reference voltage, or if both sensing signals are not the reference voltage, in response, the controller 150 alarms the current state through the application of the user terminal 3 (S50).

Specifically, when both sensing signals for one of the rotating plates 81 and 82 are not the reference voltage (S36), it is determined that the mop cloth 90 is not attached to the rotating plates 81 or 82 (S37), as shown in FIG. 9A, the phrase "Please attach the left mop cloth" is displayed on the application screen, and additionally, voice or vibration emphasizing this may be emitted.

In addition, if it is determined that the mop cloth 90 is not attached, the pump driving may be stopped and the operation may be stopped after moving to the charging stand 200, but it is stopped at the current position to protect the bottom surface and the current position can be alarmed.

On the other hand, if only one of the two sensing signals is not the reference voltage (S34), it is determined that the mop cloth 90 is not properly attached to the rotating plates 81 or 82 (S35), as shown in FIG. 9*b*, the phrase "Please attach the left mop cloth normally" is displayed on the application screen, and additionally, voice or vibration emphasizing this may be emitted.

At this time, after travelling to the charging stand 200, it can be stopped, and the current position is alarmed to the user terminal 3 to induce the user to attach the mop cloth 90.

In this way, the simple sensor is disposed between the rotating plates 81 and 82 and the mop cloth 90 and the result can be transmitted to the user terminal 3 according to the sensing signal of the sensor, by performing determination on the attachment error of the mop cloth 90 without a separate signal determination module or signal transmission module, the disadvantages of wet cleaning can be eliminated.

In the above, preferred embodiments of the present disclosure have been illustrated and described, but the present disclosure is not limited to the above-described specific embodiments, and the technical field to which the present disclosure pertains without departing from the gist of the present disclosure claimed in the claims. Of course, various modifications can be made by those skilled in the art, and these modifications should not be individually understood from the technical idea or prospect of the present disclosure.

| [EXPLANATION OF REFERENCE NUMERAL] | |
|---|---|
| 100: robot cleaner | 10: main body |
| 32: water tank | 34: pump |
| 38: drive motor | 80: rotary mop |
| 150: controller | 110: motion detection unit |
| 120: floor detection unit | 130: storage unit |
| 140: input unit | 160: mop detection unit |

What is claimed is:

1. A robot cleaner comprising:

a main body forming an outer shape;

a pair of rotary mops configured to rotate in contact with a floor to move the main body, and to clean the floor using a mop cloth attached to a lower rotating plate;

a drive motor configured to rotate the pair of rotary mops;

a mop sensing unit comprising at least one micro switch provided on a surface of the rotating plate, the mop sensing unit being configured to detect a presence of a mop cloth and output a sensing signal when the mop cloth is attached; and a controller configured to determine an attachment state of the mop cloth based on the sensing signal, the controller being configured to control the driving of the pair of rotary mops, wherein the mop sensing unit is disposed on a side of the rotating plate facing the mop cloth.

2. The robot cleaner of claim 1, wherein the micro switch is configured to output, to the controller, a reference voltage applied to the micro switch as the sensing signal when the mop cloth is attached.

3. The robot cleaner of claim 1, comprising a plurality of micro-switches arranged on each rotary mop, wherein the controller is configured to determine the attachment state of the mop cloth based on sensing signals from the plurality of micro-switches.

4. The robot cleaner of claim 3, wherein the controller is configured to determine that the mop cloth is attached normally when the sensing signals transmitted from the plurality of micro-switches comprise a reference voltage applied to the plurality of micro-switches.

5. The robot cleaner of claim 2, wherein the controller is configured to determine that the mop cloth is attached normally when the reference voltage is transmitted for at least a predetermined time.

6. The robot cleaner of claim 4, wherein the controller is configured to determine that the mop cloth is attached abnormally when at least one of the sensing signals is inconsistent with the reference voltage.

7. The robot cleaner of claim 4, wherein the controller is configured to determine that the mop cloth is not attached when at least one of the sensing signals is inconsistent with the reference voltage.

8. The robot cleaner of claim 1, wherein the micro switch comprises:

a spring configured to receive a reference voltage, an output terminal spaced apart from the spring and being configured to output the sensing signal, an actuator configured to apply an external pressure to energize the spring and the output terminal, and a molding case configured to at least partially enclose the spring and output terminal.

9. The robot cleaner of claim 8, wherein the micro switch is configured to transmit the reference voltage to the output terminal when the spring and the output terminal are in contact based on the mop cloth being attached.

10. The robot cleaner of claim 1, wherein the controller is configured to transmit an alarm signal to a user terminal when the mop cloth is attached abnormally.

11. A robot system comprising:

a robot cleaner configured to perform a wet cleaning in a cleaning area;

a server configured to communicate with and control the robot cleaner; and a user terminal configured to interact with the robot cleaner and the server, and configured to activate an application for control of the robot cleaner, wherein the robot cleaner comprises:

a main body forming an outer shape;

a pair of rotary mops configured to rotate in contact with a floor to move the main body, and to clean the floor using a mop cloth attached to a lower rotating plate;

a drive motor configured to rotate the pair of rotary mops;

a mop sensing unit comprising at least one micro switch provided on a surface of the rotating plate, the mop sensing unit being configured to detect a presence of a mop cloth and output a sensing signal when the mop cloth is attached; and a controller configured to determine an attachment state of the mop cloth based on the sensing signal, the controller being configured to control the driving of the pair of rotary mops, wherein the mop sensing unit is disposed on a side of the rotating plate facing the mop cloth.

12. The robot system of claim 11, wherein the micro switch is configured to output to the controller a reference voltage applied to the micro switch as the sensing signal when the mop cloth is attached.

13. The robot system of claim 11, comprising a plurality of micro-switches arranged on each rotary mop, wherein the controller is configured to determine the attachment state of the mop cloth based on sensing signals from the plurality of micro-switches.

14. The robot system of claim 13, wherein:

the controller is configured to determine that the mop cloth is attached normally when the sensing signals from the plurality of micro-switches comprise a reference voltage applied to the plurality of micro-switches, the controller is configured to determine that the mop cloth is attached abnormally when the sensing signal of at least one of the plurality of micro-switches is inconsistent with the reference voltage, and the controller is configured to determine that the mop cloth is not attached when at least one of the sensing signals is inconsistent with the reference voltage.

15. The robot system of claim 11, wherein the controller is configured to:

periodically receive the sensing signal from the mop sensing unit, analyze the sensing signal to determine the attachment state of the mop cloth, and transmit information indicative of the attachment state to the application.

* * * * *